US006652938B1

(12) United States Patent
Nishikawa et al.

(10) Patent No.: US 6,652,938 B1
(45) Date of Patent: Nov. 25, 2003

(54) MEDIA TRANSPORT BELT

(75) Inventors: Yasushi Nishikawa, Otsu (JP); Koji Sezaki, Otsu (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/434,272

(22) Filed: Nov. 5, 1999

(30) Foreign Application Priority Data

Nov. 9, 1998 (JP) ..... 10-317469
Mar. 9, 1999 (JP) ..... 11-061486
Apr. 30, 1999 (JP) ..... 11-123421

(51) Int. Cl.[7] ..... B32B 9/04; B32B 15/02; B32B 15/08

(52) U.S. Cl. ..... 428/35.9; 428/35.7; 428/67; 428/328; 428/421; 428/422; 399/9; 399/15; 399/49; 399/303; 271/18.1; 271/193; 271/275

(58) Field of Search ..... 428/35.7, 35.9, 428/421, 422, 67, 328; 399/9, 15, 49; 271/18, 193, 275

(56) References Cited

U.S. PATENT DOCUMENTS 4,244,465 A * 1/1981 Hishikawa et al. ..... 198/691
4,678,701 A * 7/1987 Pennington et al. ..... 428/213
5,021,109 A * 6/1991 Petropoulos et al. ..... 156/137
5,104,731 A * 4/1992 Gager ..... 428/323

FOREIGN PATENT DOCUMENTS

JP 62-56058 B 7/1985

OTHER PUBLICATIONS

Appendix 2, Table of Characteristics of Plastic, pp. 890, 891, 904, 905, *Plastics Handbook,* Publ. Date: Feb. 20, 1979.

Table 6.8, List of Characteristics of Synthetic Resin, pp. 1426–1432, *Organic Chemistry,* Publ. Date: Jan. 10, 1984.

*Material Dera Book,* pp. 456–459 & 619–621, Publ. Date: Mar. 31, 1989.

* cited by examiner

*Primary Examiner*—Sandra M. Nolan
(74) *Attorney, Agent, or Firm*—Fitch, Even, Tabin & Flannery

(57) ABSTRACT

A media transport belt with excellent electrostatic absorption, resistance to dielectric breakdown, and ink resistance, which comprises a tubular film made of polymer material, an electrode pattern formed on the surface of the tubular film, and an electrode protective layer with volume resistance of from $10^9$ to $10^{15}$ Ω·cm dielectric constant of equal to or greater than 3.0 on the electrode pattern.

10 Claims, 4 Drawing Sheets

MEDIA TRANSPORT BELT

BACKGROUND OF THE INVENTION

1. Field of the Invention

The present invention relates to a media transport belt. More specifically, the present invention relates to a belt that is used for transporting single sheets of paper, overhead transparency film, or the like in an electrophotographic apparatus such as a copying machine, a laser beam printer, and a facsimile, or a belt that is used for transporting or drying shingle sheets of paper, overhead transparency film, or the like in an ink jet printer or bubble jet printer.

2. Description of Related Art

Electrophotographic apparatuses such as a copying machine employs a method for transporting a sheet of paper, film and the like by mounting it on a resin belt made of PC, vinylidene fluoride, or the like, or by attracting it to the surface of a resin belt which is electrically charged previously.

In the case of transporting single sheets of paper, film or the like by a resin belt, stable conveyance is difficult to be achieved because paper or the like often slips on the belt. When single sheets of paper, film or the like are transported by attracting them by electric charges provided to the belt, paper cannot be accurately attracted on the belt due to lack of attraction force for a sheet, which causes a problem that the tip portion of a sheet is warped upward during transportation. Especially, in order to obtain a higher-speed printer, it is necessary to improve attraction force of the belt for a sheet as well as to attract such media as paper or overhead transparency film more accurately to the belt. Moreover, it is necessary that the belt has adequate attraction force for a sheet under various conditions, for example, under high temperature and high humidity conditions.

In the case of an ink jet printer or bubble jet printer, it is necessary to dry ink during transportation of a sheet. For this reason, the belt is required to have heat resistance. Furthermore, in order to shorten the drying time by drying the belt at a higher temperature, the belt is required to have much higher heat resistance. The belt is also required to have ink resistance to prevent deterioration of the belt caused by the component of ink and to prevent dielectric breakdown caused by water absorption of a sheet. Moreover, the belt is required to be prevented from being deteriorated due to the ink adhering to the surface of the belt. In many cases, ink for a printer is alkaline, therefore, the belt is required to have resistance to alkali.

BRIEF SUMMARY OF THE INVENTION

As the result of our researches to solve the above problems and to obtain a high-speed printer or the like, the inventors of the present invention have eventually attained a media transport belt which has excellent heat resistance, high withstanding voltage, and ink resistance in response to its structure and material properties, and to which a sheet is electrostatically attracted through the application of voltage to the electrodes formed on it.

A media transport belt according to the present invention, which overcomes the above-discussed and numerous other disadvantages and deficiencies of the prior art, comprising: a tubular film made of polymeric material; conductive electrodes formed in predetermined patterns on the outer surface of the tubular film; and an electrode protective layer formed on the electrodes, wherein the electrode protective layer consists of resin or composite resin having volume resistivity of $10^9$~$10^{15}$ Ω·cm and dielectric constant of equal to or greater than 3.0.

Polymeric material for a tubular film is not particularly limited, but such material having a proper tensile elastic modulus and a proper glass transition temperature can be selectively used as polymeric material for the tubular film.

As resin or composite resin for an electrode protective layer, such resin or the like having a low coefficient of water absorption or having ink resistance can be selectively used.

Accordingly, an object of the present invention is to provide a media transport belt having an excellent electrostatic attraction force and being capable of transporting single sheets of paper or overhead transparency film by attracting them adequately to its surface.

Another object of the present invention is to provide a media transport belt having an excellent electrostatic absorption under high temperature and high humidity conditions and an excellent resistance to dielectric breakdown caused by water absorption by forming an electrode protective layer from resin with low coefficient of water absorption.

A further object of the present invention is to provide a media transport belt having a sufficient attraction force for printed media, an excellent electrostatic attraction force under high temperature and high humidity conditions, an excellent resistance to dielectric breakdown caused by water absorption, and excellent ink resistance, even if it is used in an ink jet printer. The above force and resistances are provided to the belt by forming an electrode protective layer of the belt from resin having low coefficient of water absorption, and by providing an ink-resistant outer layer to the outer surface of the electrode protective layer of the belt.

BRIEF DESCRIPTION OF THE DRAWINGS

In the accompanying drawings.

DESCRIPTION OF THE PREFERRED EMBODIMENTS

Figure 1:
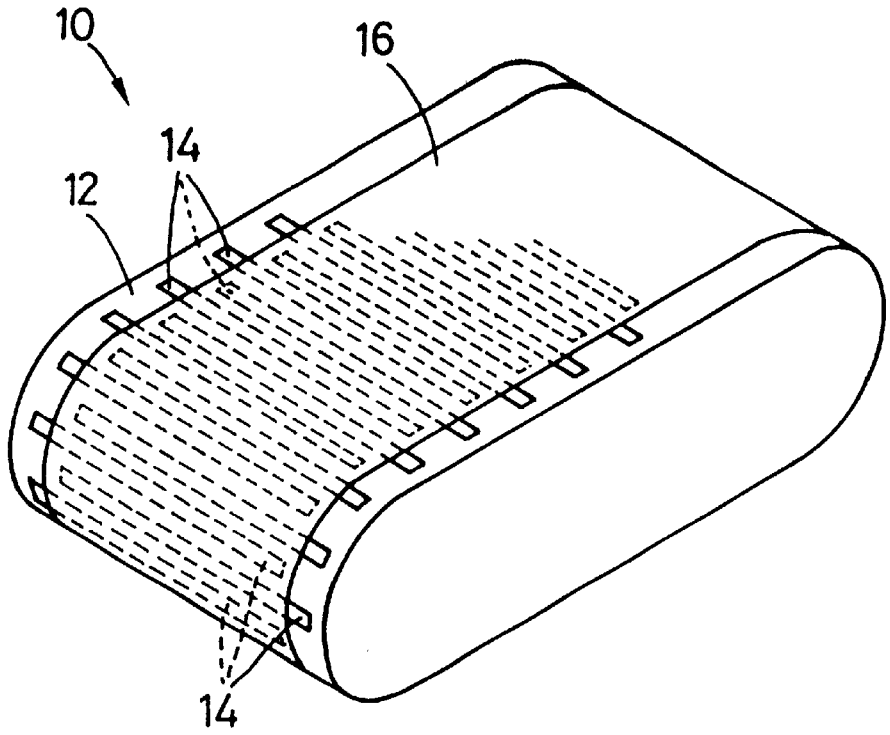
FIG. 1 is a perspective view of a media transport belt according to the present invention.

The term "media" or "medium" used herein includes sheets of paper, overhead transparency film or the like.

Preferred embodiments of the present invention will hereinafter be described with reference to FIGS. 1 to 9. In the drawings, like reference numerals denote like elements.

Figure 2:
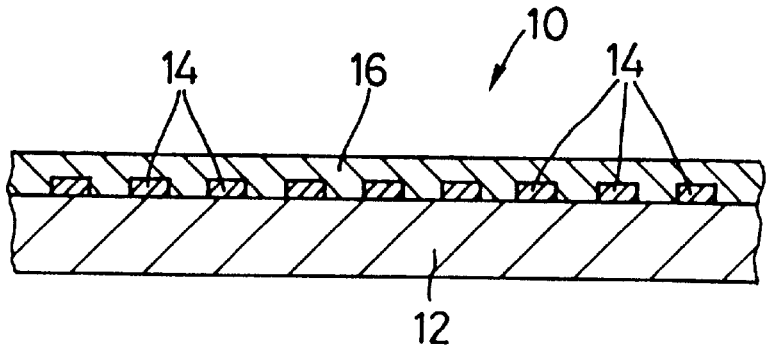
FIG. 2 is an enlarged fragmentary sectional view of the media transport belt shown in FIG. 1.
Figure 3:
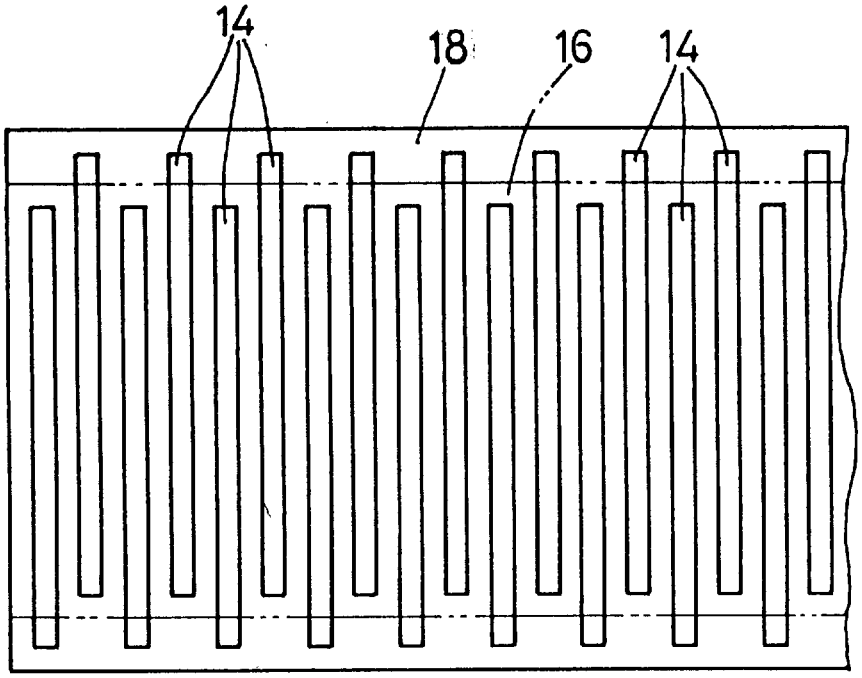
FIG. 3 is a fragmentary top plan view of the media transport belt shown in FIG. 1.

As shown in FIGS. 1 and 2, a media transport belt 10 of the present invention comprises a tubular film 12 made of polymeric material, conductive electrodes 14 formed in predetermined patterns (electrode pattern)on the outer surface of the tubular film 12; and an electrode protective layer 16 formed on the electrodes 14. The electrode protective layer 16 has volume resistivity of $10^9$~$10^{15}$ Ω·cm and dielectric constant of equal to or greater than 3.0.

In the present invention, the volume resistivity of a resin was measured by preparing a 100 μm-thick resin film from the resin, allowing the resin film to stand under the circumstances of a temperature of 20° C. and humidity of 60% for 24 hours, and applying a voltage of 500V to the obtained film by using super-insulation resistance meter Model SM-10 (TOA Electronics Ltd.). The dielectric constant of the present invention was measured by preparing a resin film having a thickness of 200 μm or more, allowing the resin film to stand under the circumstances of a temperature of 20° C. and humidity of 60% for 24 hours, and obtaining a value at a frequency of 1 kHz by using a dielectric loss measurement instrument AS-4245(ANDO ELECTRIC CO., LTD.). In any cases, the electrode having 38 m in diameter was used.

As polymeric material for a tubular film 12 of the present invention, engineering plastic can be used for example. Concretely, preferable polymeric material is one or a combination of two or more kinds selected form a group consisting of polyamide 6, polyamide 66, polyamide 46, polyamide MXD6, polycarbonate, polyacetal, polyphenylene ether, PET(polyethylene terephthalate), PBT(polybutylene terephthalate), PEN(polyethylene naphthalate), polyarylate, liquid crystal polyester, polyphenylene sulfide, polysulfone, polyethersulfone, polyetheretherketone, polyetherimide, polyamideimide, aramid, non-thermoplastic polyimide, thermoplastic polyimide, fluorocarbon polymers, ethylene-vinylalcohol copolymer, polymethyl pentene, phenol resin, unsaturated polyester resin, epoxy resin, silicone, and diallylphthalate resin. More preferable polymeric material is a material having a tensile modulus of 200 kg/mm$^2$ or more and/or a glass transition temperature of 150° C. or more. Such polymeric material can be reinforced with filler, fiber or the like to improve its elastic modulus and glass transition temperature. A tensile elastic modulus and a glass transition temperature are measured in accordance with American Society for Testing & Materials ASTM D882 and Japanese Industrial Standard JIS K 7121, respectively. Another more preferable polymeric material is non-thermoplastic polyimide or thermoplastic polyimide.

Of the above, thermoplastic polyimide resin having a glass transition temperature Tg of 150° C. or more, preferably 230° C. or more is preferably used. The media transport belt 10 is a belt that is used for transporting single sheets of paper or overhead transparency film in electrophotographic apparatus such as a copying machine, a laser beam printer, or a facsimile, or a belt that is used for transporting and drying single sheets of paper or overhead transparency film in an ink jet printer or bubble jet printer. Accordingly, thermoplastic polyimide resin for the media transport belt 10, which has a glass transition temperature Tg of 150° C. or more, preferably 230° C. or more, can function as heat-resistant resin when the belt is used.

Next, an example of thermoplastic polyimide resin that is used for a tubular film of the media transport belt of the present invention will be described. Unlike conventional non-thermoplastic (thermo-setting) polyimide film, thermoplastic polyimide film has heat resistance, fusion fluidity in a high temperature range, and an excellent workability. Furthermore, in a jointed part of the heat-resistant resin belt of the present invention, thermoplastic polyimide film has an adhesive property superior to non-thermoplastic polyimide film. It is preferred that thermoplastic polyimide film that is used in the present invention contains a main ingredient represented by the general formula (1)

general formula (1)

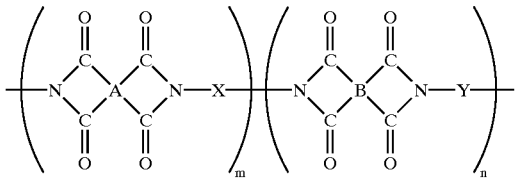

wherein m and n are equal to molar fractions of respective repeating units of polymer chain, m is within the range from about 0.1 to about 0.9, n is within the range from about 0.9 to about 0.1, the ratio between m and n is about 0.01 to 0.9, both A and B are tetravalent organic groups, and X and Y are bivalent organic groups. Concretely, in the general formula (1), A, which is derived from acid dianhydride as a monomer for providing thermoplasticity, is preferably at least one kind selected from tetravalent organic groups represented by the general formula (2)

general formula (2)

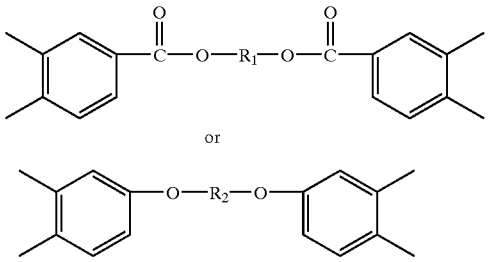

wherein $R_1$ and $R_2$ are bivalent organic groups. Further, in the general formula (1), B is preferably at least one kind selected from tetravalent organic groups represented by

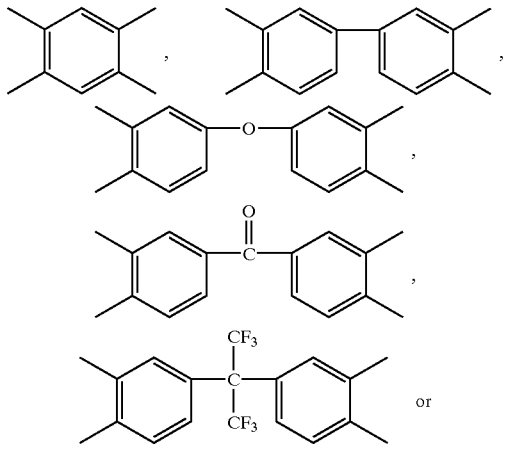

-continued

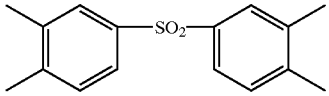

Furthermore, in the general formula (1), X and Y, which are derived from diamines as monomers for providing thenmoplasticity, are preferably at least one kind selected from bivalent organic groups represented by the general formula (3)

general formula (3)

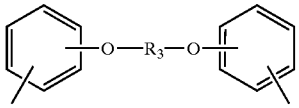

wherein $R_3$ indicates a bivalent organic group), or chemical formula

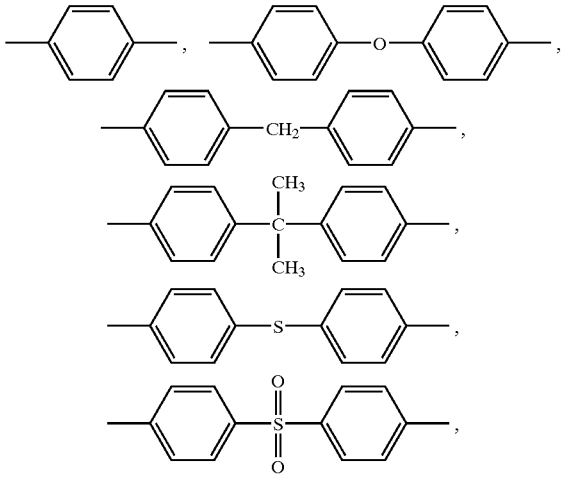

-continued

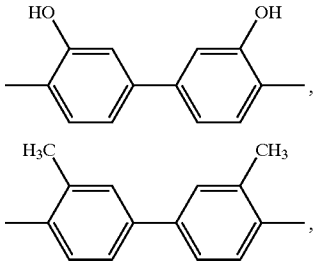

-continued

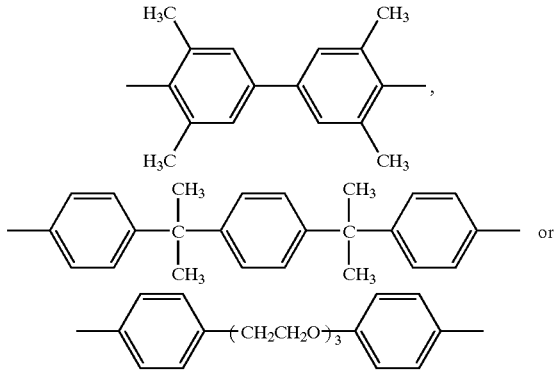

Next, an example of a method for producing thermoplastic polyimide which can be used for the heat-resistant resin belt of the present invention will be described below. First, acid dianhydride, preferably, 10 to 90 mol%, having ester group in molecular chain shown in the general formula (2), and dianhydride consisting of aromatic acid dianhydride, shown in the above chemical formula, preferably, pyromellitic acid dianhydride, are allowed to react with diamine shown in the general formula (3), and chemical formulas above in an organic solvent to obtain polyamide acid solution, which is a precursory solution of polyimide. Then, the polyamide acid solution is imidized by being heated and dried to obtain polyimide. However, the above embodiment is just one example of a method for producing thermoplastic polyimide. The method is not limited to the above-mentioned process.

A film for polymeric material which is used for the media transport belt can be a film consisting, for example, only of the above thermoplastic polyimide, however, film consisting of a mixture of thermoplastic polyimide and other resin can also be used. Non-thermoplastic polyimide film which is used for the media transport belt of the present invention can be a film consisting of resin represented by the general formula (4), general formula (4)

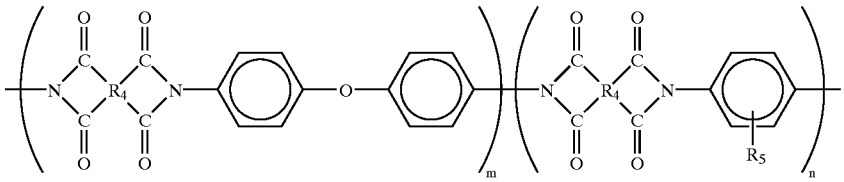

wherein $R_4$ is a tetravalent organic group represented by

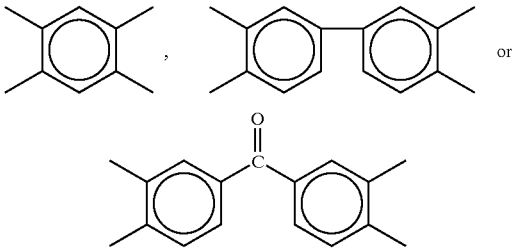

$R_5$ is a hydrogen atom or a monovalent substituent, m and n are integers, and m/n is from 0.1 to 100. However, the film is not limited to the one made from this material.

Non-thermoplastic polyimide film used herein includes all the resins of thermo-setting polyimide resin, reaction-setting resin, and the like. Non-thermoplastic polyimide film, for example, can be a film consisting only of non-thermoplastic polyimide resin, however, a film consisting of a mixture of non-thermoplastic polyimide resin and additives can also be used. In the latter case, the mixture is obtained by mixing a precursor of non-thermoplastic polyimide film with additives.

Next, a method for forming a tubular film 12 will be concretely described below. The tubular film can be formed by bonding both ends of non-thermoplastic polymeric material by thermoplastic material; by heat bonding both ends of thermoplastic polymeric material; or by heat bonding non-thermoplastic polymeric material and thermoplastic polymeric material with the butts of the two materials slightly displaced from each other. Further, the tubular film can also be obtained by molding non-thermoplastic polymeric material and thermoplastic polymeric material into a tubular-shaped mold. Thus, the method for forming the tubular film 12 is not particularly limited, but the tubular film can be formed by any method.

On the surface of the tubular film 12, electrodes 14 are formed in predetermined patterns: by screen printing conductive paste, which is made of silver, copper, aluminum, carbon or the like, on the tubular film 12 or the electrode protective layer 16 by adhering metal foil or metal film made of aluminum, cupper, or the like to the surface of the tubular film 12 and then etching it to make a patterned electrode; or by evaporating such metal as aluminum or the like onto the tubular film 12 through a mask formed into a predetermined pattern. These electrodes 14 are formed to jut alternatively from both sides of the electrode protective layer so that a voltage can be placed between the electrodes. The patterns of the electrodes 14 are not limited to the patterns shown in the drawings, but for example, the electrodes 14 can be formed like the teeth of a comb dovetailed with each other.

In consideration of uneven surfaces of the tubular film caused by the electrodes 14, the thicknesses of the electrodes 14 may be within the rage of 2 to 30 $\mu$m, and preferably, 5 to 20 $\mu$m. The trace widths and pitches of the electrode 14 can be arbitrarily set.

Then the electrode protective layer 16 is formed on the outer surface of the tubular film 12, on which electrodes 14 are formed, to protect the electrodes 14 from external forces.

The electrode protective layer 16 used herein consists of resin or composite resin having volume resistance of $10^9$ to $10^{15}$ $\Omega$·cm and dielectric constant of equal to or greater than 3.0. The terms "composite resin" and "resin-additive composite" used herein are interchangeable and mean material consisting of a resin and conductive additives and/or additives having high dielectric constant.

As resin for the electrode protective resin 16, thermoplastic resin, non-thermoplastic resin, rubber, and thermoplastic elastomer can be used. These resins include thermosetting resin, reaction-setting resin, or resin known as ionomer can be used for example. More concretely, one kind or a combination of two or more kinds selected from a group consisting of below-described polymers are preferably used: isobutylene maleic anhydride copolymer, AAS (acrylonitrile-acryl-styrene copolymer), AES(acrylonitrile-ethylene-styrene copolymer), AS(acrylonitrile-styrene copolymer), ABS(acrylonitrile-butadiene-tyrene copolymer), ACS(acrylonitrile-chlorinated polyethylene-styrene copolymer), MBS(methylmethacrylate-butadiene-styrene copolymer), ethylene-vinyl chloride-copolymer, EVA(ethylene-vinyl acetate copolymer) and the derivatives thereof, EVOH(ethylene-vinylalcohol copolymer), polyvinyl acetate, chlorinated vinyl chloride, chlorinated polyethylene, chlorinated polypropylene, carboxyvinyl polymer, ketone resin, norbornate resin, propionic acid vinyl, PE(polyethylene), PP(polypropylene), methyl pentene polymers, polybutadiene, PS(polystyrene), styrene maleic anhydride copolymer, methacryl, EMAA(ethylene methacrylic acid), PMMA(polymethylene methacrylate), PVC(polyvinyl chloride), polyvinylidenecloride, PVA (polyvinyl alcohol), polyvinyl ether, polyvinyl butyral, polyvinyl formal, cellulose and the derivatives thereof, nylon 6, nylon 6 copolymer, nylon 66, nylon 610, nylon 612, nylon 11, nylon 12, copolymer nylon, nylon MXD, nylon 46, methoxymethyl nylon, aramid, PET(polyethylene terephthalate), PBT(polybutylene terephthalate), PC(polycarbonate), POM(polyacetal), polyethylene oxide, PPE(polyphenylene ether), denaturated PPE(polyphenylene ether), PEEK(polyetheretherketone), PES (polyethersulfone), PSF(polysulfone), polyamine sulfone, PPS(polyphenylene sulhide), PAR(polyarylate), polyparavinyl phenol, polyparamethylene styrene, polyallyl amine, aromatic polyester, liquid crystal polymer, PTFE (polytetrafluoroethylene), ETFE(tetrafluoroethylene-ethylene), FEP(tetrafluoroethylene-hexafluoropropylene), EPE(tetrafluoroethylene-hexafluoropropylene-perfluoroalkylvinyl ether, PFA(tetrafluoroethylene-perfluoroalkylvinyl ether, PCTFE(polychlorotrifluoroethylene), ECTFE(ethylene-chlorotrifluoroethylene), PVDF(polyvinylidene fluoride type), PVF(polyvinylfluoride), PU(polyurethane), phenol resin, urea resin, melamine resin and the derivatives thereof, guanamine resin, vinyl ester resin, unsaturated polyester, oligoesteracrylate, diallylphthalate, DKF resin, xylene resin, epoxy resin, fran resin, PI(polyimide and derivatives thereof), PEI(polyetherimide), PAI(polyamideimide), acrylic silicone, silicon, poly(p-hydroxybenzoic acid), maleic resin, NR(natural rubber), IR(isoprene rubber), SBR (styrene-butadiene rubber), BR(butadiene rubber), CR(chloroprene rubber), IIR(isobutylene-isoprene rubber), NBR(nitrile butadiene rubber), EPM(ethylene propylene rubber), EPDM(ethylene propylenedienerubber), CPE (chlorinated polyethylene rubber), CSM(chlorosulfonated polyethylene rubber), ACM(acrylic rubber), ethylene acrylic rubber, U(urethane rubber), silicone rubber, fluoro rubber, tetrafluoroethylene propylene rubber, CHR(epichlorhydrin rubber), polysulfide rubber, nitrile hydroxide rubber, polyether type special rubber, liquid rubber, norbornene rubber, TPO(olefine type thermoplastic elastomer), TPU(urethane type thermoplastic elastomer), PVC(polyvinyl chloride thermoplastic elastomer), TPS(styrene type thermoplastic elastomer), TREE(polyester type thermoplastic elastomer), PA type (polyamide elastomer), PB type (butadiene elastomer), soft fluorocarbon polymers, fluorocarbon elastomer, elastic epoxy resin and the like.

When the media transport belt of the present invention is exposed to high temperatures, resin for the electrode protective layer 16 is preferably the one having a glass transition temperature Tg of 150° C. or more, and more preferably polyimide resin or thermoplastic polyimide resin having a glass transition temperature Tg of 150° C. or more.

It is preferred that resin for the electrode protective layer 16 has low water absorption to prevent leakage of current, to maintain sufficient attraction force under high temperature and high humidity conditions, and to have excellent resistance to dielectric breakdown caused by ink absorption. Particularly, when attraction force is required under the circumstances of ambient temperature of 30° C. and relative humidity of 80%, resin having 1% or less water absorption is preferably used for the electrode protective layer, and resin having 0.5% or less is more preferably used. Concretely, resin having 1% or less water absorption is at least one resin selected from the group consisting of chlorosulfonated polyethylene rubber, olefine resin and the derivatives thereof, styrene resin and the derivatives thereof, acrylic resin and the derivatives thereof, silicone resin and the derivatives thereof, aromatic resin and the derivatives thereof, polyacetal resin and the derivatives thereof, polyvinyl chloride resin and the derivatives thereof, polyvinylidenechloride resin and the derivatives thereof, amide resin and the derivatives thereof, urethane resin and the derivatives thereof, nitrile resin and the derivatives thereof, phenol resin, urea resin, melamine resin, guanamine resin, vinyl ester resin, epoxy resin, furan resin, and fluorocarbon polymers; or it is a mixed resin containing 30 vol. % or more of at least one resin selected from the group consisting of chlorosulfonated polyethylene rubber, olefine resin and the derivatives thereof, styrene resin and the derivatives thereof, acrylic resin and the derivatives thereof, silicone resin and the derivatives thereof, aromatic resin and the derivatives thereof, polyacetal resin and the derivatives thereof, polyvinyl chloride resin and the derivatives thereof, polyvinylidenechloride resin and the derivatives thereof, amide resin and the derivatives thereof, urethane resin and the derivatives thereof, nitrile resin and the derivatives thereof, phenol resin, urea resin, melamine resin, guanamine resin, vinyl ester resin, epoxy resin, furan resin, and fluorocarbon polymers. Water absorption is measured in accordance with Japanese Industrial Standard JIS K 7209. More concretely, a test sample of a film is dried for 24±1 hours in the thermostat in which the temperature is kept at 50±2° C. and then it is cooled down in the desiccator. Water absorption is calculated from the equation:

$$\text{Water absorption}(\%)=(W_2-W_1)\div W_1\times 100$$

wherein $W_1$ indicates the weight of the film which is cooled down in the desiccator, and $W_2$indicates the weight of the film prepared by soaking a test sample of a film in distilled water for 24 hours and then wiping away the drops of water on the surface of the film. Thus, water absorption used in this specification is obtained by the above measuring method and calculation.

It is preferable that resin having water absorption of 1% or less is used for an electrode protective layer, because attraction force and resistance to dielectric breakdown under high temperature and high humidity conditions are provided to the media transport belt 10. If ink resistance is required to be provided to the belt surface, it is preferable that the electrode protective layer consists of ink-resistant resin or composite resin made by blending ink-resistant resin with a conductive additive and/or an additive having high dielectric constant. On the outer surface of the electrode protective layer, an outer layer can be formed from resin or composite resin made by blending ink-resistant resin with a conductive additive and/or an additive having high dielectric constant.

The ink-resistant resin is not particularly limited, however, it may consist of at least one resin or a mixed resin containing 30 vol. % or more of at least one resin selected from the group consisting of fluorocarbon polymers and the derivatives thereof, olefine resin and the derivatives thereof, styrene resin and the derivatives thereof, acrylic resin and the derivatives thereof, silicone resin and the derivatives thereof, polyacetal resin and the derivative thereof, aromatic resin and the derivatives thereof and the derivative thereof.

Concretely, such ink-resistant resin can be at least one kind or a combination of two or more kinds selected form the group consisting of PTFE(polytetrafluoroethylene), ETFE(tetrafluoroethylene-ethylene), FEP (tetrafluoroethylene-hexafluoropropylene), EPE (tetrafluoroethylene-hexafluoropropylene-perfluoroalkylvinyl ether), PFA(tetrafluoroethylene-perfluoroalkylvinyl ether), PCTFE(polychlorotrifluoroethylene), ECTFE(ethylene-chlorotrifluoroethylene), PVDF(polyvinylidene fluoride type), PVF(polyvinylfluoride), vinylidene fluoride-hexafluoropropylene type rubber, vinylidene fluoride-hexafluoropropylene-tetrafluoroethylene type rubber, vinylidene fluoride-pentafluoropropylene type rubber, vinylidene fluoride-pentafluoropropylene-tetrafluoroethylene type rubber, vinylidene fluoride-perfluoromethylvinylether-tetrafluoroethylene type rubber, vinylidene fluoride-chlorotrifluoroethylene type rubber, fluororubber(typical examples are thermoplastic fluororubber such as Daiel T-530 and Daiel T-630 from DAIKIN INDUSTRIES, LTD.), soft fluorocarbon polymers(typical examples are CEFRALSOFT G150F100N, CEFRALSOFT G150F200, and the like), fluorocarbon elastomer, isobutylene maleic anhydride copolymer, AAS(acrylonitrile-acrylstyrene copolymer), AES(acrylonitrile-ethylene-styrene copolymer), AS(acrylonitrile-styrene copolymer), ABS (acrylonitrile-butadien-styrene copolymer), ACS (acrylonitrile-chlorinated polyethylene-styrene copolymer), MBS(methylmethacrylate-butadien-styrene copolymer), ethylene-vinyl chloride-copolymer, EVA(ethylene-vinyl acetate copolymer), EVA type (ethylene-vinyl acetate copolymer type), EVOH(ethylene-vinylalcohol copolymer), chlorinated vinyl chloride, chlorinated polyethylene, chlorinated polypropylene, carboxyvinyl polymer, norbornate resin, PE(polyethylene), PP(polypropylene), methyl pentene polymers, polybutadiene, PS(polystyrene), styrene maleic anhydride copolymer, methacryl, EMAA(ethylene methacrylic acid), PMMA(polymethylene methacrylate), polyvinyl ether, polyvinyl butyral, polyvinyl formal, NR(natural rubber), IR(isoprene rubber), SBR(styrene-butadiene rubber), BR(butadiene rubber), CR(chloroprene rubber), IIR (isobutylene-isoprene rubber), NBR(nitrile butadiene rubber), EPM(ethylene propylene rubber), EPDM(ethylene propylenedien rubber), CPE(chlorinated polyethylene rubber), CSM(chlorosulfonated polyethylene rubber), ACM (acrylic rubber), ethylene acrylic rubber, norbornate rubber, TPO(olefine type thermoplastic elastomer), TPS(styrene type thermoplastic elastomer), PB type(butadiene elastomer), PVC(polyvinyl chloride), PVC(polyvinyl chloride type thermoplastic elastomer), silicone rubber, acrylic silicone, POM, PEEK, PEK(polyetherketone), PPE, PPS, PSF(polysulfone), PES, PBT, PET, PEN, PC, PAR (polyarylate), and liquid crystal polyester.

The above ink-resistant polymer can be olefine resin and the derivatives thereof, styrene resin and the derivatives thereof, or acrylic resin and the derivatives thereof having a functional group, $—CH_2—CR_1R_2-$ (wherein $R_1$ or $R_2$ represents H, $CH_3$, Ph, or COOX, and X is an organic group); or resin containing 30 vol. % or more of olefine resin and the derivatives thereof, styrene resin and the derivatives thereof, or acrylic resin and the derivatives thereof having a functional group, $—CH_2—CR_1R_2—$.

In another embodiment, the above ink-resistant polymer can be at least one selected from the group consisting of polyacetal, polyetheretherketone, polyetherketone, polyphenylene ether, polyphenylene sulfide, polysulfone, polyethersulfone, polybutylene terephthalate, polyethylene terephthalate, polyethylene naphthalate, polycarbonate, polyarylate, and liquid crystal polyester.

In still another embodiment, the above ink-resistant polymer can be fluorocarbon polymers having a functional group selected from the group consisting of —$CF_2$—$CFR_3$— (wherein $R_3$ is H, Cl, or F), —$CH_2$—CF2—, and —$CH_2$—CHF—; or resin containing 30 vol. % or more of fluorocarbon polymers having a functional group selected from the group consisting of —$CF_2$—$CFR_3$—(wherein $R_3$ is H, Cl, or F), —$CH_2$—$CF_2$—, and —$CH_2$—CHF—.

In further embodiment, the above ink-resistant polymer can be polyvinylidenechloride resin and derivatives thereof having a functional group of —$CH_2$—$CCl_2$—, or resin containing 30 vol. % or more of polyvinylidenechloride resin and derivatives thereof having a functional group of —$CH_2$—$CCl_2$—.

In still further embodiment, the above ink-resistant polymer can be polyvinyl chloride resin and derivatives thereof having a functional group of —$CH_2$—CHC1—, or resin containing 30 vol. % or more of polyvinyl chloride resin and derivatives thereof having a functional group of —$CH_2$—CHC1—.

Volume resistivity of resin for the electrode protective layer 16 should be $10^9$ to $10^{15}$ Ω·cm and preferably $10^{10}$ to $10^{14}$ Ω·cm. A dielectric constant of resin for the electrode protective layer 16 should be 3.0 or more and preferably 5.0 or more. If volume resistivity is less than $10^9$ Ω·cm, defective insulation between adjacent electrodes 14 causes leakage of current. In contrast, if volume resistivity is more than $10^{15}$ Ω·cm, attraction force decreases because electrical charges are hard to be induced on the surface of the electrode protective layer 16, and moreover, even after voltage applied to electrodes are removed, residual electric charges remain on the surface of the electrode protective layer for a long time, so that paper does not come off the surface. Thus, such resin having volume resistivity of more than $10^{15}$ Ω·cm is not preferable. If a dielectric constant is less than 3.0, shortage of electrical charges is caused on the surface of the belt during the application of voltage, and attraction force for a sheet decreases to an inadequate level. Thus, resin having a dielectric constant is less than 3.0 is not preferable. For the purpose of forming the electrode protective layer 16 from resin having predetermined volume resistivity and dielectric constant, it is preferable that conductive powders and/or high dielectric powders are blended appropriately with resin to make the electrode protective layer 16.

The conductive powders to be used for adjusting volume resistivity of resin for the electrode protective layer 16 can be carbon powders, graphite, metal powders, metallic oxide powders, conductive-treated metallic oxide, antistatic agent and the like. In accordance with intended purposes, at least one conductive powders selected from the above can be used. The amount of conductive powders to be added depends on desired volume resistivity of the electrode protective layer 16. Generally, it is preferable to add 2 to 50 vol. % conductive powders of the whole volume of the layer 16 and more preferable to add 3 to 30 vol. % conductive powders. The size of conductive powders is not particularly limited. Generally, the average powder size is preferably 50 μm or less, more preferably 10 μm or less, and most preferably 1 μm or less.

As the high dielectric powders, which are used for adjusting dielectric constant of resin for the electrode protective layer 16, non-organic powders having a dielectric constant of 50 or more, such as titanium oxide, barium titanate, potassium titanate, lead titanate, lead niobate, zirconate titanate, magnetic powders or the like can be used. Preferably, non-organic powders having a dielectric constant of 100 or more, such as barium titanate, zirconate titanate, titanium oxide, magnetic powders or the like can be used. The shape of high dielectric powders is not particularly limited, however, at least one kind selected from spherical, flake-like, or whisker-like powders can be used. The size of high dielectric powders is not particularly limited, either. If dielectric powders are spherical in shape, the average powder size is preferably 50 μm or less, more preferably 10 μm or less, and most preferably lam or less. If dielectric powders are whisker-like in shape, such powders having a length of 50 μm or less and a diameter of 0.5 to 20 μm can be used. Further, the amount of high dielectric powders to be added depends on a desired dielectric constant of the electrode protective layer 16. Generally, it is preferable to add 5 to 50 vol. % dielectric powders of the whole volume of the layer 16 and more preferable to add 10 to 30 vol. % dielectric powders.

Next, one embodiment of a method for producing the media transport belt of the present invention is described below, although it is not limited to this embodiment. First, a tubular film 12 is formed from polymeric material as a seamless belt by a casting method, and electrodes 14 are formed in predetermined patterns on the outer surface of the tubular film 12. Then electrode protective layer 16 is formed on the electrodes 14 by a coating method except on the ends of the electrodes, which alternatively jut out from the layer. Thus, the media transport belt 10 can be produced.

Another embodiment of producing the media transport belt 10 is as follows. A film is preformed from polymeric material, and a belt-like tubular film 12 is formed by joining the both ends of the preformed film, and then, electrodes 14 and an electrode protective layer 16 is produced. A further embodiment of producing the belt 10 is: forming electrodes 14 in predetermined patterns on the surface of a film 18 made of polymeric material, forming an electrode protective layer 16 as shown by the dotted lines in FIG. 3, and then joining both ends of the film 18 to produce a belt-like media transport belt 10. A still further embodiment is: forming electrodes 14 in predetermined patterns on the surface of a film 18 made of polymeric material, joining both ends of the film 18 to form a belt-like film, and then forming an electrode protective layer 16 as shown by the dotted lines in FIG. 3 to produce the media transport belt 10.

The electrode protective layer 16 can be formed by applying the varnish-state raw resin to the electrodes 14, or by laminating film-like raw rein on the electrodes 14. Usable laminating method can be heat-pressing, heat-rolling, and thermo-compression bonding methods, although it is not limited by these methods.

A method for producing the media transport belt of the present invention varies depending on the intended purposes of the belt or materials for the tubular film, electrode protective layer, or the like. Further, a method for producing the media transport belt of the present invention can be varied in response to the structure of other embodiments of media transport belt described below.

The structure of the media transport belt is not limited to the one shown in FIG. 1. For example, another preferred embodiment of the present invention is a media transport belt shown in FIG. 4, which comprises an outer layer 20 on the electrodes 14 and the electrode protective layer 16 laminated on the outer surface of the tubular film 12 to protect the electrode protective layer 16. The outer layer 20 may consist of any resin which can be used as material for the electrode protective layer 16, for example. Among these resins, preferable resin is the one having water absorption of 1% or less, and more preferable resin is the one having an ink resistance. Typical examples of resin having water absorption of 1% or less or an ink resistance, which are used for the outer layer 20, are the same as listed above for the electrode protective layer 16. The outer layer 20 may have volume resistivity of $10^9$ to $10^{15}$ Ω·cm and a dielectric constant of 3.0 or more.

Figure 4:
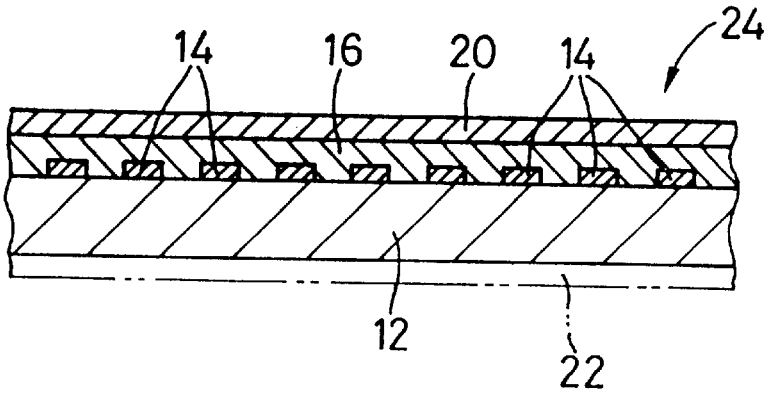
FIG. 4 is an enlarged fragmentary sectional view showing another embodiment of the media transport belt according to the present invention.

Still another preferred embodiment of the present invention is a media transport belt 24, which comprises a resin layer 22 on the inner surface of the tubular film 12, as shown in FIG. 4 by the dotted lines. The resin layer 22 consists of the same material and has the same thickness as the outer layer 20, and may prevent the resultant media transport belt 24 from being warped.

Figure 5:
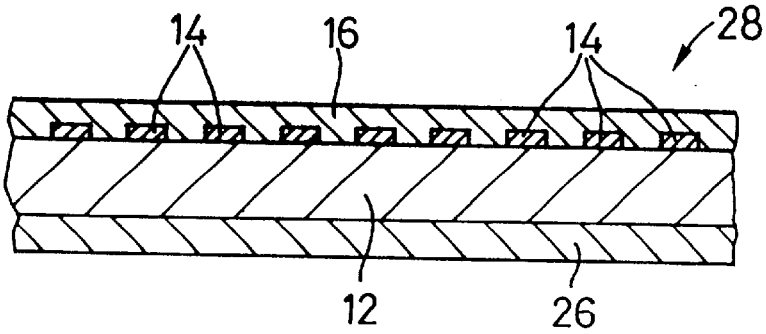
FIG. 5 is an enlarged fragmentary sectional view showing still another embodiment of the media transport belt according to the present invention.

A further preferred embodiment of the present invention is a media transport belt 28 shown in FIG.5, which comprises a resin layer 26 on the inner surface of the tubular film 12, while the electrodes 14 and the electrode protective layer 16 are formed on the outer surface of the film 12. The resin layer 26 consists of the same material and has the same thickness as the electrode protective layer 16. Such a symmetrical structure except the electrodes 14 can prevent the media transport belt 28 from being warped.

Figure 6:
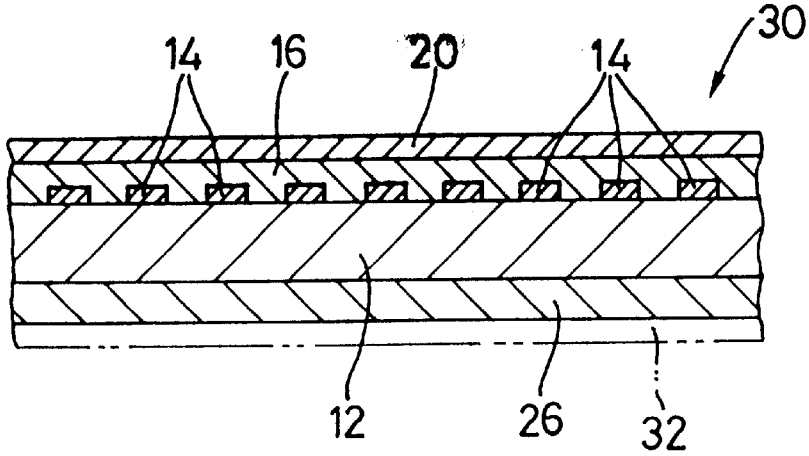
FIG. 6 is an enlarged fragmentary sectional view showing a further embodiment of the media transport belt according to the present invention.

A still further preferred embodiment of the present invention is a media transport belt 30 shown in FIG. 6, which comprises a resin layer 26 on the inner surface of the tubular film 12, and an outer layer 20 on the electrode protective layer 16 to protect the electrode protective layer 16, while the electrodes 14 and the electrode protective layer 16 are formed on the outer surface of the film 12. In this case, the resin layer 26 consists of the same material and has the same thickness as the electrode protective layer 16, but material for the outer layer 20 is not necessarily the same as that for the resin layer 26 on the inner surface of the tubular film 12. The media transport belt 30 may also comprise another resin layer 32, which consists of the same material and has the same thickness as the outer layer 20, on the inner surface of the resin layer 26.

Figure 7:
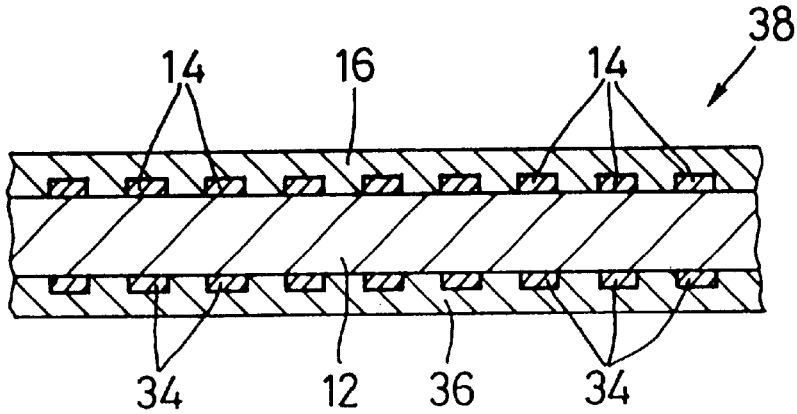
FIG. 7 is an enlarged fragmentary sectional view showing a still further embodiment of the media transport belt according to the present invention.
Figure 8:
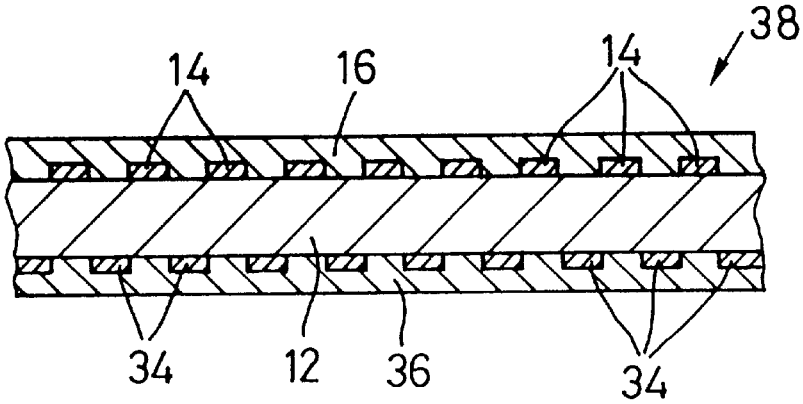
FIG. 8 is an enlarged fragmentary sectional view showing another embodiment of the media transport belt according to the present invention.

Another preferred embodiment of the present invention is a media transport belt 38 shown in FIG. 7, which comprises electrodes 34 and an electrode protective layer 36 on the inner surface of the tubular film 12 as well as the electrodes 14 and the electrode protective layer 16 on the outer surface of the tubular film 12. The electrodes 34 on the inner surface of the tubular film 12 and the electrodes 14 on the outer surface of the tubular film 12 can be symmetrical as shown in FIG. 7, however the electrodes 34 and 14 can be formed in a staggered format, as shown in FIG. 8. Such a substantially symmetrical structure of the media transport belt can prevent the belt from being warped, even after it is used for a long time.

In the media transport belt 38 shown in FIGS. 7 and 8, the electrodes 34 on the inner surface of the tubular film 12 are not particularly limited. The electrodes 34 can be dummies which do not function as electrodes. The electrodes 34 can be so formed that a voltage is placed between the electrodes 34 and the electrodes 14. Such a completely symmetrical structure of the media transport belt 38 can prevent the ends of the belt from being warped.

EXAMPLES

The present invention will be more clearly understood by referring to the Examples below. However, these Examples should not be construed to limit the invention in any way.

Example 1

On non-thermoplastic polyimide film 12 (Apical 50NPI from KANEKA CORP.) having a thickness of 50 μm, electrodes 14 having a width of 10 mm, a thickness of 10 μm, and an interelectrode distance of 3 mm were formed from epoxy silver paste in predetermined patterns as shown in FIG. 1 and FIG. 2.

Then, an electrode protective layer 16 consisting mainly of non-thermoplastic polyimide was produced as follows. 5.6 g of carbon black #2700 (Mitsubishi Chemical Corp.) was added to 410 g of DMF(dimethylformamide), 20 g of ODA(4,4', diaminodiphenylether) was dissolved, and 21.8 g of PMDA(pyromellitic acid dianhydride) was dissolved in this order and mixed under nitrogen atmosphere in an ice bath to prepare about 2000 poises of polyamide acid solution at the temperature of 23 ° C. This solution was spread over the electrodes 14 formed in predetermined patterns and dried for 10 minutes at 100° C., for 5 minutes at 150° C., for 5 minutes at 200° C., and for 5 minutes at 300° C. to form a 50 μm-thick electrode protective layer 16. This electrode protective layer 16 had volume resistivity of $2.0\times10^{13}$ Ω·cm, a dielectric constant of 8.0, and water absorption of 2.5%. Then, both ends of thus-obtained film 10 are joined together to form a media transport belt 10.

Figure 9:
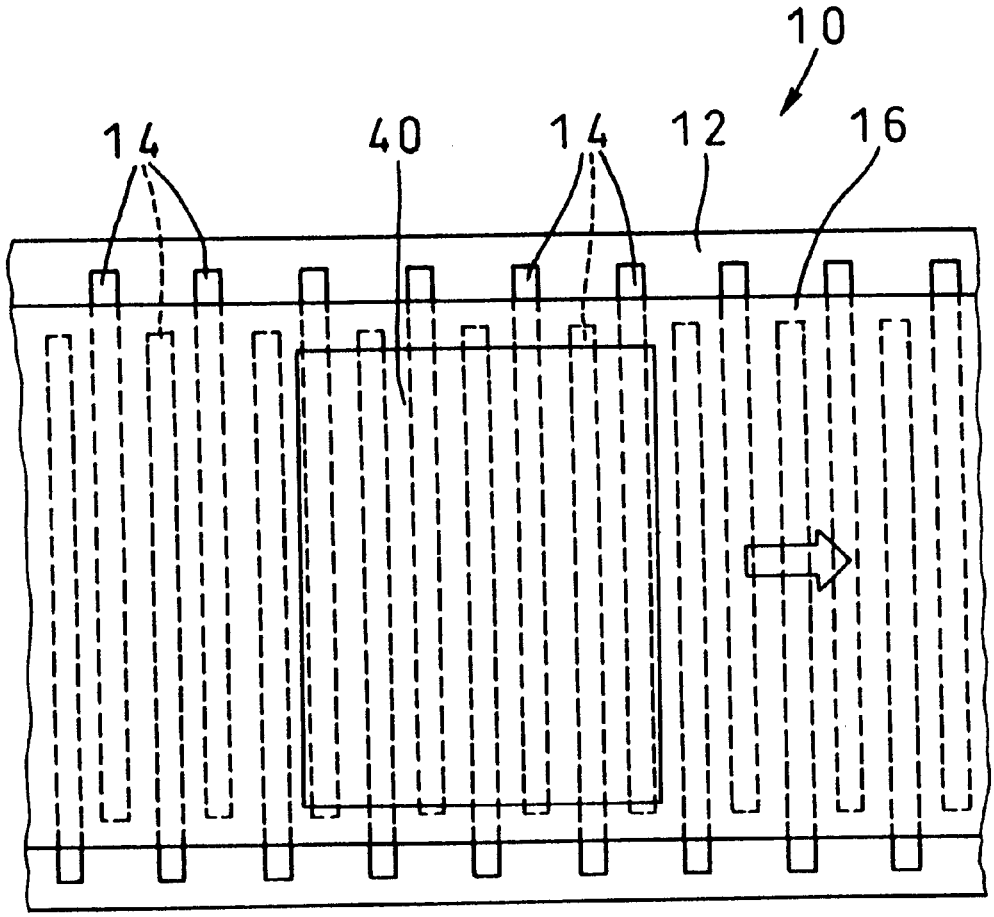
FIG. 9 is a fragmentary top plan view showing a method for testing attraction force of media transport belt according to the present invention.

To measure attraction force of this media transport belt 10 for paper, 3 kV of direct voltage was placed between the electrodes 14, and an A4-format sheet of paper 40 was made to be attracted by the belt 10 under the conditions of the normal ambient temperature and humidity(20° C.·60%) as shown in FIG. 9 (NN attraction force). Then, paper 40 was pulled in the direction shown by the arrow, that is, in the direction parallel to the surface of the belt 10. At this measurement, the highest force exerted on the paper 40 to move was defined as the belt's attraction force for paper 40. The result of the measurement is shown in Table 1. It is clear from Table 1 that its attraction force for paper 40 was excellent.

Examples 2 to 5

The media transport belts 10 were obtained in the same manner as Example 1, but material for the electrode protective layer 16 was different in each example as shown in Table 1. The electrode protective layers 16 were formed from non-thermoplastic polyimide resin and 20 vol. % of conductive titanium oxide(ET-600W from ISHIHARA SANGYO KAISHA, LTD) in Example 2; non-thermoplastic polyimide resin and 30 vol. % of barium titanate(BT-100P from Fuji Titanium Industry Co.,Ltd.) in Example 3; non-thermoplastic polyimide resin, 5 vol. % of carbon black and 30 vol. % of barium titanate in Example 4; and non-thenmoplastic polyimide resin, 5 vol. % of titanium oxide and 30 vol. % of barium titanate in Example 5, respectively. Volume resistivity and a dielectric constant of the electrode protective layer 16 obtained in each example are shown in Table 1. In the same manner as Example 1, attraction force for paper 40 was measured in each example. It is clear from Table 1 that the attraction force for paper 40 was excellent in each example.

Example 6

The media transport belt 10 was obtained in the same manner as the above Examples, but material for the electrode protective layer 16 was different. In Example 6, the electrode protective layer 16 was formed from urethane resin(Y258 from DAINICHISEIKA COLOUR & CHEMICALS MFG. CO.,LTD.) having volume conductivity of $2.4\times10^{12}$ Ω·cm and a dielectric constant of 7.0. In the same manner as the above, attraction force for paper 40 was measured. The result of the measurement is shown in Table 1.

Comparative Example 1

The media transport belt 10 was obtained in the same manner as Example 1, but material for the electrode protective layer 16 is different. In Comparative Example 1, the electrode protective layer 16 was formed from non-thermoplastic polyimide resin having volume conductivity of $1.0\times10^{16}$ Ω·cm and a dielectric constant of 3.0. In the same manner as the Example 1, attraction force for paper 40 was measured. The result of the measurement is shown in Table 1. It is clear from Table 1 that the attraction force for paper 40 was considerably low.

TABLE 1

| | electrode protective layer | | | | | | | | | | |
|---|---|---|---|---|---|---|---|---|---|---|---|
| | resin | | | | conductive additives | | high dielectric additive | | volume | | NN |
| | type | volume resistivity (Ω · cm) | dielectric constant | amount vol. % | type | amount vol. % | type | amount vol. % | resistivity (Ω · cm) | dielectric constant | attraction force (kg) |
| EXAMPLE 1 | polyimide | 1.0E + 16 | 3 | 90 | carbon black | 10 | — | — | 2.0E + 13 | 8 | 11.0 |
| EXAMPLE 2 | polyimide | 1.0E + 16 | 3 | 80 | conductive titanium oxide | 20 | — | — | 3.0E + 12 | 23 | 12.1 |
| EXAMPLE 3 | polyimide | 1.0E + 16 | 3 | 70 | — | — | barium titanate | 30 | 1.2E + 13 | 15 | 11.5 |
| EXAMPLE 4 | polyimide | 1.0E + 16 | 3 | 65 | carbon black | 5 | barium titanate | 30 | 7.0E + 12 | 16 | 12.0 |
| EXAMPLE 5 | polyimide | 1.0E + 16 | 3 | 65 | conductive titanium oxide | 5 | barium titanate | 30 | 5.0E + 12 | 18 | 12.4 |
| EXAMPLE 6 | urethane | 1.0E + 12 | 7 | 100 | — | — | — | — | 2.4E + 12 | 7 | 14.0 |
| COMPARATIVE EXAMPLE 1 | polyimide | 1.0E + 16 | 3 | 100 | — | — | — | — | 1.0E + 16 | 3 | 2.4 |
| COMPARATIVE EXAMPLE 2 | polyimide | 1.0E + 16 | 3 | 90 | carbon black | 30 | — | — | 2.0E + 7 | 18 | 1.5 |
| COMPARATIVE EXAMPLE 3 | polyimide | 1.0E + 16 | 3 | 50 | conductive titanium oxide | 30 | — | — | 3.0E + 8 | 25 | 2.0 |
| COMPARATIVE EXAMPLE 4 | polypropylene | 1.0E + 18 | 2.6 | 100 | — | — | — | — | 1.0E + 18 | 2.6 | 2.5 |

Comparative Examples 2 and 3

The media transport belts 10 were obtained in the same manner as Example 1, but material for the electrode protective layer 16 was different in each example as shown in Table 1. The electrode protective layers 16 were formed from non-thermoplastic polyimide resin and 20 vol. % of carbon black in Comparative Example 2; and non-thermoplastic polyimide resin and 30 vol. % of conductive titanium oxide in Comparative Example 3, respectively. Volume resistivity and a dielectric constant of the electrode protective layer 16 obtained in each example are shown in Table 1. In the same manner as Example 1, attraction force for paper 40 was measured in each example. It is clear from Table 1 that attraction force for paper 40 was considerably low in each example.

Comparative Example 4

The media transport belt 10 was obtained in the same manner as Example 1, but material for the electrode protective layer 16 was different. In Comparative Example 4, the electrode protective layer 16 was formed from polypropylene resin (F112ZB from Grand Polymer Co., Ltd.) having volume conductivity of $1.0\times10^{18}$ Ω·cm and a dielectric constant of 3.0. In the same manner as the Example 1, attraction force for paper 40 was measured. The result of the measurement is shown in Table 1. It is clear from Table 1 that attraction force for paper 40 was considerably low.

Examples 7 to 13

The media transport belts 10 were obtained in the same manner as Example 1, but material for the electrode protective layer 16 was different in each example as shown in Table 2. The electrode protective layers 16 were formed from amide resin (TOMIDE#560 from Fuji Kasei Co.,Ltd.) having volume resistivity of $5.1\times10^{9}$ Ω·cm, an dielectric constant of 10 and water absorption of 0.6 in Example 7; amide resin (TOMIDE#1360 Fuji Kasei Co.,Ltd.) having volume resistivity of $8.4\times10^{11}$ Ω·cm, an dielectric constant of 4.2 and water absorption of 0.4 in Example 8; amide resin(a mixture of TOMIDE#560 and TOMIDE#1360 from Fuji Kasei Co.,Ltd. in a ratio of 9:1) having volume resistivity of $1.4\times10^{14}$ Ω·cm, an dielectric constant of 4 and water absorption of 0.4 in Example 9; composite resin consisting of amide resin (TOMIDE#394 Fuji Kasei Co.,Ltd.) having volume resistivity of $3.0\times10^{16}$ Ω·cm, an dielectric constant of 3.2 and water absorption of 0.3 and 10 vol. % of carbon black in Example 10; composite rein consisting of amide resin (TOMIDE#394 from Fuji Kasei Co.,Ltd.) having volume resistivity of $3.0\times10^{16}$ Ω·cm, an dielectric constant of 3.2 and water absorption of 0.3 and 20 vol. % of conductive titanium oxide in Example 11; composite resin consisting of amide resin (TOMIDE#394 from Fuji Kasei Co.,Ltd.) having volume resistivity of 3.0 X $^{16}$ Ω·cm, an dielectric constant of 3.2 and water absorption of 0.3 and 20 vol. % of antistatic agent(REOREX AS from Dai-ichi Kogyo Seiyaku Co., Ltd.) in Example 12; composite resin consisting of amide resin (TOMIDE#394 from Fuji Kasei Co.,Ltd.) having volume resistivity of $3.0\times10^{16}$ Ω·cm, an dielectric constant of 3.2 and water absorption of 0.3 and 30 vol. % of barium titanate in Example 13, respectively. Volume resistivity and a dielectric constant of the electrode protective layer 16 obtained in each example are shown in Table 2. In the same manner as Example 1, NN attraction force for paper 40 was measured in each example. The results of the measurements are shown in Table 2. HH attraction force for paper 40 was also measured in each example in the same manner as the above, but the measurement conditions was not at normal ambient temperature and humidity, but at high temperature and high humidity(30° C.·80%). It is clear from Table 2 that the NN attraction force for paper 40 was excellent and the HH attraction force for paper 40 was high.

To measure voltage resistance of the media transport belt 10 obtained in each example, 3 kV of direct voltage was placed between the electrodes 14, and an A4-format sheet of paper 40 was made to be attracted by the belt 10 under the conditions of the normal ambient temperature and humidity (20° C.·60%) as shown in FIG. 9. Then, paper 40 was moistened with water with an automatic spray, and then the presence or absence of dielectric breakdown was checked. More concretely, the voltage was held at 3 kV and it was held constant for 1 minute after spraying water. The measuring device had the mechanism that the voltage was stopped to be applied when 1 mA or more current flew. Therefore, if 1 mA or more current flew after 1 minute, it was considered that dielectric breakdown occurred. If the current was held at less than 1 mA, it was considered that no dielectric breakdown occurred. In Table 2, ○ indicates the absence of dielectric breakdown, respectively. As shown in Table 2, voltage resistance of each belt was high.

TABLE 2

| | electrode protective layer | | | | | | | | | | | |
|---|---|---|---|---|---|---|---|---|---|---|---|---|
| | resin | | | | | conductive additive | | | | | | |
| | type | volume resistivity (Ω · cm) | dielectric constant | water absorption | amount vol. % | type | amount vol. % | volume resistivity (Ω · cm) | dielectric constant | NN attraction force (kg) | HH attraction force (kg) | withstanding voltage |
| EXAMPLE 7 | amide | 5.1E + 9 | 10 | 0.6 | 100 | — | — | 5.1E + 09 | 10 | 12.5 | 8.0 | ○ |
| EXAMPLE 8 | amide | 8.4E + 11 | 4.2 | 0.4 | 100 | — | — | 8.4E + 11 | 4.2 | 13.8 | 8.5 | ○ |
| EXAMPLE 9 | amide | 1.5E + 14 | 4 | 0.4 | 100 | — | — | 1.5E + 14 | 4 | 13.5 | 8.4 | ○ |
| EXAMPLE 10 | amide | 3.0E + 16 | 3.2 | 0.3 | 90 | carbon black | 10 | 2.5E + 13 | 10 | 12.1 | 7.9 | ○ |
| EXAMPLE 11 | amide | 3.0E + 16 | 3.2 | 0.3 | 80 | conductive titanium oxide | 20 | 6.2E + 11 | 35 | 13.6 | 8.5 | ○ |
| EXAMPLE 12 | amide | 3.0E + 16 | 3.2 | 0.3 | 80 | antistatic agent | 20 | 8.0E + 12 | 8 | 10.5 | 7.5 | ○ |
| EXAMPLE 13 | amide | 3.0E + 16 | 3.2 | 0.3 | 70 | barium titanate | 30 | 2.0E + 13 | 30 | 16.6 | 11.0 | ○ |
| EXAMPLE 14 | epoxy | 3.5E + 10 | 5 | 0.9 | 100 | — | — | 3.5E + 10 | 5 | 15.1 | 10.0 | ○ |
| EXAMPLE 15 | epoxy | 8.0E + 12 | 4.5 | 0.8 | 100 | — | — | 8.0E + 12 | 4.5 | 16.1 | 11.0 | ○ |
| EXAMPLE 16 | epoxy | 1.4E + 14 | 3.5 | 0.7 | 100 | — | — | 1.4E + 14 | 3.5 | 11.4 | 8.0 | ○ |
| EXAMPLE 17 | epoxy | 1.4E + 14 | 3.5 | 0.7 | 90 | carbon black | 10 | 5.0E + 12 | 9 | 12.6 | 8.2 | ○ |
| EXAMPLE 18 | epoxy | 1.4E + 14 | 3.5 | 0.7 | 80 | conductive titanium oxide | 20 | 6.2E + 12 | 38 | 13.6 | 8.4 | ○ |
| EXAMPLE 19 | epoxy | 1.4E + 14 | 3.5 | 0.7 | 80 | antistatic agent | 20 | 4.8E + 13 | 10 | 13.8 | 8.2 | ○ |
| EXAMPLE 20 | epoxy | 1.4E + 14 | 3.5 | 0.7 | 70 | barium titanate | 30 | 1.5E + 13 | 25 | 15.6 | 9.8 | ○ |

Examples 14 to 20

The media transport belts 10 were obtained in the same manner as Example 1, but material for the electrode protective layer 16 was different in each example as shown in Table 2. The electrode protective layers 16 were formed from epoxy resin (a mixture of bisphenol A-type epoxy resin Epikote 1001 (Yuka Shell Epoxy Kabushiki Kaisha) and novolac-type phenol resin PSM-4327 from Gun Ei Chemical Industry Co.,Ltd. in a ratio of 450:100) having volume resistivity of $3.5\times10^{10}$ Ω·cm, an dielectric constant of 5 and water absorption of 0.9 in Example 14; epoxy resin (a mixture of bisphenol A-type epoxy resin Epikote 1001 (Yuka Shell Epoxy Kabushiki Kaisha) and cresol novolac-type epoxy resin 180S65 (Yuka Shell Epoxy Kabushiki Kaisha) in a ratio of 1:1) having volume resistivity of $8.0\times10^{12}$ Ω·cm, an dielectric constant of 4.5 and water absorption of 0.8 in Example 15; epoxy resin (a mixture of cresol novolac-type epoxy resin 180S65 and novolac-type phenol resin PSM-4327 in a ratio of 200:100) having volume resistivity of $1.4\times10^{14}$ Ω·cm, an dielectric constant of 3.5 and water absorption of 0.7 in Example 16; composite resin consisting of epoxy resin used in Example 16 and 10 vol. % of carbon black in Example 17; composite resin consisting of epoxy resin used in Example 16 and 20 vol. % of conductive titanium oxide in Example 18; composite resin consisting of epoxy resin used in Example 16 and 20 vol. % of antistatic agent in example 19; and composite resin consisting of epoxy resin used in Example 16 and 30 vol. % of barium titanate in Example 20, respectively. Volume resistivity and a dielectric constant of the electrode protective layer 16 obtained in each example are shown in Table 2. In the same manner as Examples 7 to 13, NN attraction force for paper 40, HH attraction force for paper 40 and voltage resistance were measured in each example. It is clear from the results shown in Table 2 that the attraction force for paper 40 was excellent and the HH attraction force for paper 40 and the voltage resistance were high in each example.

Examples 21 to 34

The media transport belts 10 were obtained in the same manner as Example 1, but material for the electrode protective layer 16 was different in each example as shown in Table 3. The electrode protective layers 16 were formed from composite resin consisting of PFA resin (Aflon PFA from Asahi Glass Co. ,Ltd.) having volume resistivity of $1.0\times10_{18}$ Ω·cm, an dielectric constant of 2.1 and water absorption of 0.03 and 30 vol. % of barium titanate in Example 21; composite resin consisting of PVDF resin (KF polymer #1000 from Kureha Chemical Industry Co.,Ltd.) having volume resistivity of $1.0\times10^{15}$ Ω·cm, an dielectric constant of 11.0 and water absorption of 0.3 and 30 vol. % of barium titanate in Example 22; soft fluorocarbon polymers(CEFRALSOFT G150F200 from Central Glass Co.,Ltd.) having volume resistivity of $3.4\times10^{14}$ Ω·cm, an dielectric constant of 6.4 and water absorption of 0.04 in Example 23; a mixture of Miractran 22M(Nippon Polyurethane Industry Co.,Ltd.) and a mixture (CEFRALSOFT G150F200 from Central Glass Co.,Ltd.) of urethane resin and soft fluorocarbon polymers having volume resistivity of $2.5\times10^{12}$ Ω·cm, an dielectric constant of 6.8 and water absorption of 0.5 in a ratio of 50:100 in Example 24; composite resin consisting of soft fluorocarbon polymers and 30 vol. % of barium titanate in Example 25; fluorocarbon elastomer(Dai-el T-530 from DAIKIN INDUSTRIES, LTD.) having volume resistivity of $5.0\times10^{13}$ Ω·cm, an dielectric constant of 5.9 and water absorption of 0.1 in Example 26; PVF resin (Tedlar TST20SG4 from E.I. duPont de Nemours and Company) having volume resistivity of $1.2\times10^{14}$ Ω·cm, an dielectric constant of 6.5 and water absorption of 0.5 in Example 27; PVC resin (Sumilit SX-8G from SUMITOMO CHEMICAL CO., LTD.) having volume resistivity of $1.5\times10^{13}$ Ω·cm, an dielectric constant of 4.0 and water absorption of 0.4 in Example 28; composite resin consisting of TPO resin(MILASTOMER 5030N from Mitsui Chemicals, Inc.) having volume resistivity of $1.0\times10^{18}$ Ω·cm, an dielectric constant of 2.6 and water absorption of 0.1 and 30 vol. % of barium titanate in Example 29; composite resin consisting of methyl pentene polymers (TPX-RT18 from Mitsui Chemicals, Inc.) having volume resistivity of $1.0\times10^{18}$ Ω·cm, an dielectric constant of 2.5 and water absorption of 0.1 and 30 vol. % of barium titanate in Example 30; composite resin consisting of methacrylic resin (Sumipex-BLO-6 from SUMITOMO CHEMICAL CO., LTD.) having volume resistivity of $1.0\times10^{17}$ Ω·cm, an dielectric constant of 3.1 and water absorption of 0.3 and 30 vol. % of barium titanate in Example 31; composite resin consisting of acrylic silicone resin(KANEKA GEMLAC from KANEKA CORP.) having volume resistivity of $1.0\times10^{17}$ Ω·cm, an dielectric constant of 3.2 and water absorption of 0.3 and 30 vol. % of barium titanate in Example 32; composite resin consisting of silicone resin(KE 1254 from Shin-Etsu Chemical Co.,Ltd.) having volume resistivity of $1.0\times10^{15}$ Ω·cm, an dielectric constant of 3.4 and water absorption of 0.2 and 30 vol. % of barium titanate in Example 33; and composite resin consisting of PEEK resin (SUMIPLOY K CK4600 from SUMITOMO CHEMICAL CO., LTD.) having volume resistivity of $1.1\times10^{16}$ Ω·cm, an dielectric constant of 3.0 and water absorption of 0.1 and 30 vol. % of barium titanate in Example 34, respectively. Volume resistivity and a dielectric constant of the electrode protective layer 16 obtained in each example are shown in Table 3. In the same manner as Examples 7 to 13, NN attraction force for paper 40, HH attraction force for paper 40 and voltage resistance were measured in each example. It is clear from the results shown in Table 3 that the NN attraction force for paper 40 was excellent and the HH attraction force for paper 40 and the voltage resistance were high in each example.

An evaluation of ink-resistance of each media transport belt was conducted as follows. Ink for an ink jet printer (cyanogens, magenta, yellow, and black) was dropped on the electrode protective layer 16 and then the layer 16 was wiped with a damp cloth to observe the appearance. In Table 3, ○ indicates that the ink was wiped away. It is clear from Table 3 that ink-resistance of every media transport belts was high.

TABLE 3

| | electrode protective layer | | | | | | | | | NN | HH | | |
|---|---|---|---|---|---|---|---|---|---|---|---|---|---|
| | resin | | | | | conductive additives | | | | attraction | attraction | | |
| | type | volume resistivity (Ω · cm) | dielectric constant | water absorption | amount vol. % | type | amount vol. % | volume resistivity (Ω · cm) | dielectric constant | force (kg) | force (kg) | withstanding voltage | ink resistance |
| EXAMPLE 21 | PFA | 1.0E + 18 | 2.1 | 0.03 | 70 | barium titanate | 30 | 1.4E + 14 | 25 | 10.0 | 7.8 | ○ | ○ |
| EXAMPLE 22 | PVDF | 1.0E + 15 | 11 | 0.03 | 70 | barium titanate | 30 | 3.3E + 13 | 30 | 11.2 | 8.0 | ○ | ○ |
| EXAMPLE 23 | soft fluorocarbon resin | 3.4E + 14 | 6.4 | 0.04 | 100 | — | — | 3.4E + 14 | 6.4 | 13.3 | 8.5 | ○ | ○ |
| EXAMPLE 24 | a mixture of soft fluorocarbon resin and urethane resin | 2.5E + 12 | 6.8 | 0.5 | 100 | — | — | 2.5E + 12 | 6.8 | 16.0 | 8.5 | ○ | ○ |
| EXAMPLE 25 | soft fluorocarbon resin | 3.4E + 14 | 6.4 | 0.04 | 70 | barium titanate | 30 | 2.1E + 13 | 32 | 15.5 | 9.0 | ○ | ○ |
| EXAMPLE 26 | fluorocarbon elastomer | 5.0E + 13 | 5.9 | 0.1 | 100 | — | — | 5.0E + 13 | 5.9 | 14.4 | 8.8 | | |
| EXAMPLE 27 | PVF | 1.2E + 14 | 6.5 | 0.5 | 100 | — | — | 1.2E + 14 | 6.5 | 12.2 | 8.5 | ○ | ○ |
| EXAMPLE 28 | PVC | 1.5E + 13 | 4.0 | 0.4 | 100 | — | — | 1.5E + 13 | 4 | 13.5 | 9.0 | ○ | ○ |
| EXAMPLE 29 | TPO | 1.0E + 18 | 2.6 | 0.1 | 70 | barium titanate | 30 | 2.1E + 14 | 23 | 10.8 | 7.5 | ○ | ○ |
| EXAMPLE 30 | TPX | 1.0E + 18 | 2.5 | 0.1 | 70 | barium titanate | 30 | 3.5E + 14 | 23 | 11.5 | 7.8 | ○ | ○ |
| EXAMPLE 31 | methacryl | 1.0E + 17 | 3.1 | 0.3 | 70 | barium titanate | 30 | 9.8E + 13 | 26 | 11.1 | 8.2 | ○ | ○ |
| EXAMPLE 32 | acrylic silicon | 1.0E + 17 | 3.2 | 0.3 | 70 | barium titanate | 30 | 6.7E + 13 | 23 | 11.5 | 8.0 | ○ | ○ |
| EXAMPLE 33 | silicone | 1.0E + 15 | 3.4 | 0.2 | 70 | barium titanate | 30 | 5.5E + 13 | 25 | 14.5 | 8.5 | ○ | ○ |

TABLE 3-continued

| | electrode protective layer | | | | | | | | | NN | HH | | |
|---|---|---|---|---|---|---|---|---|---|---|---|---|---|
| | resin | | | | conductive additives | | | | | attrac- | attrac- | | |
| | type | volume resistivity (Ω · cm) | dielectric constant | water absorption | amount vol. % | type | amount vol. % | volume resistivity (Ω · cm) | dielectric constant | tion force (kg) | tion force (kg) | withstanding voltage | ink resistance |
| EXAMPLE 34 | PEEK | 1.1E + 16 | 3.0 | 0.1 | 70 | barium titanate | 30 | 2.2E + 14 | 22 | 10.5 | 7.1 | ○ | ○ |

Example 35

As shown in FIG. 1 and FIG. 2, electrodes 14 having a width of 10 mm, a thickness of 10 μm, and an interelectrode distance of 3 mm were formed in predetermined patterns on the 50 μm-thick non-thermoplastic polyimide film 12 by using epoxy silver paste. Amide resin, which is the same as the one used in Example 8, was spread over these electrodes 14 formed in predetermined patterns to form an electrode protective layer 16 having a thickness of 37.5 μm. Further, an 12.5 μm-thick outer layer 20 made of composite resin consisting of PFA resin (Aflon PFA from Asahi Glass Co.,Ltd.) having volume resistivity of $1.0\times10^{18}$ Ω·cm, an dielectric constant of 2.1 and water absorption of 0.03 and 30 vol. % of barium titanate was formed on the electrode protective layer 16. Then, both ends of thus-obtained film 10 are joined together to obtain a media transport belt 10. In the same manner as Examples 21 to 34, NN attraction force for paper 40, HH attraction force for paper 40 and voltage resistance were measured in each example. It is clear from the results shown in Table 4 that the NN attraction force was excellent and the HH attraction force for paper 40 and the voltage resistance were high in each example.

Examples 36 to 41

The media transport belts 10 were obtained in the same manner as Example 35, but material for the outer layer 20 was different in each example as shown in Table 4. The outer layers 20 were formed from PVDF resin in Example 36; soft fluorocarbon polymers in Example 37; PVF resin in Example 38; TPO in Example 39; methacrylic resin in Example 40; and silicone resin in Example 41, respectively. In the same manner as Example 35, NN attraction force for paper 40, HH attraction force for paper 40, voltage resistance and ink-resistance were measured in each example. It is clear from the results shown in Table 4 that the NN attraction force for paper 40 was excellent, and the HH attraction force for 40, the voltage resistance, and the ink resistance were high in each example.

Example 42

As shown in FIG. 1 and FIG. 2, electrodes 14 having a width of 10 mm, a thickness of 10 μm, and an interelectrode distance of 3 mm were formed in predetermined patterns on the 50 μm-thick non-thermoplastic polyimide film 12 by using epoxy type silver paste. Epoxy resin, which is the same as the one used in Example 15, was spread over these electrodes 14 formed in predetermined patterns to form an electrode protective layer 16 having a thickness of 37.5 μm. Further, an 12.5 μm-thick outer layer 20 made of PFA resin was formed on the electrode protective layer 16. Then, both ends of thus-obtained film 10 are joined together to obtain a media transport belt 10. In the same manner as Examples 21 to 34, NN attraction force for paper 40, HH attraction force for paper 40, voltage resistance, and ink resistance were measured in each example. It is clear from the results shown in Table 4 that the NN attraction force for paper 40 was excellent and the HH attraction force for paper 40, the voltage resistance and the ink resistance were high in each example.

Examples 43 to 48

The media transport belts 10 were obtained in the same manner as Example 42, but material for the outer layer 20 was different in each example as shown in Table 4. The outer layers 20 were formed from PVDF resin in Example 43; soft fluorocarbon polymers in Example 44; PVF resin in Example 45; TPO in Example 46; methacrylic resin in Example 47; and silicone resin in Example 48, respectively. In the same manner as Example 35, NN attraction force for paper 40, HH attraction force for paper 40, voltage resistance and ink-resistance were measured in each example. It is clear from the results shown in Table 4 that the NN attraction force for paper 40 was excellent, and the HH attraction force for paper 40, the voltage resistance, and the ink resistance were high in each example.

TABLE 4

| | electrode protective layer | | | outer layer | | | | | | |
|---|---|---|---|---|---|---|---|---|---|---|
| | type | volume resistivity (Ω · cm) | dielectric constant | type | volume resistivity (Ω · cm) | dielectric constant | NN attraction force (kg) | HH attraction force (kg) | withstanding voltage | ink resistance |
| EXAMPLE 35 | amide | 8.4E + 11 | 4.2 | PFA | 1.0E + 18 | 2.1 | 10.5 | 6.8 | ○ | ○ |
| EXAMPLE 36 | amide | 8.4E + 11 | 4.2 | PVDF | 1.0E + 15 | 11 | 12.5 | 7.0 | ○ | ○ |
| EXAMPLE 37 | amide | 8.4E + 11 | 4.2 | soft fluorocarbon resin | 3.4E + 14 | 6.4 | 13.5 | 8.0 | ○ | ○ |
| EXAMPLE 38 | amide | 8.4E + 11 | 4.2 | PVF | 1.2E + 14 | 6.5 | 11.9 | 7.2 | ○ | ○ |
| EXAMPLE 39 | amide | 8.4E + 11 | 4.2 | TPO | 1.0E + 18 | 2.6 | 10.1 | 6.5 | ○ | ○ |

TABLE 4-continued

| | electrode protective layer | | | outer layer | | | | | | |
|---|---|---|---|---|---|---|---|---|---|---|
| | type | volume resistivity (Ω · cm) | dielectric constant | type | volume resistivity (Ω · cm) | dielectric constant | NN attraction force (kg) | HH attraction force (kg) | withstanding voltage | ink resistance |
| EXAMPLE 40 | amide | 8.4E + 11 | 4.2 | methacryl | 1.0E + 17 | 3.1 | 10.5 | 6.7 | ○ | ○ |
| EXAMPLE 41 | amide | 8.4E + 11 | 4.2 | silicone | 1.0E + 15 | 3.4 | 12.5 | 7.0 | ○ | ○ |
| EXAMPLE 42 | epoxy | 8.0E + 12 | 4.5 | PFA | 1.0E + 18 | 2.1 | 11.1 | 7.0 | ○ | ○ |
| EXAMPLE 43 | epoxy | 8.0E + 12 | 4.5 | PVDF | 1.0E + 15 | 11 | 13.2 | 7.2 | ○ | ○ |
| EXAMPLE 44 | epoxy | 8.0E + 12 | 4.5 | soft fluorocarbon resin | 3.4E + 14 | 6.4 | 13.5 | 8.0 | ○ | ○ |
| EXAMPLE 45 | epoxy | 8.0E + 12 | 4.5 | PVF | 1.2E + 14 | 6.5 | 12.2 | 6.8 | ○ | ○ |
| EXAMPLE 46 | epoxy | 8.0E + 12 | 4.5 | TPO | 1.0E + 18 | 2.6 | 10.2 | 6.2 | ○ | ○ |
| EXAMPLE 47 | epoxy | 8.0E + 12 | 4.5 | methacryl | 1.0E + 17 | 3.1 | 11.0 | 6.5 | ○ | ○ |
| EXAMPLE 48 | epoxy | 8.0E + 12 | 4.5 | silicone | 1.0E + 15 | 3.4 | 12.9 | 7.0 | ○ | ○ |

Examples 49 to 55

The media transport belts 10 were obtained in the same manner as Example 35, but material for the outer layer 20 was different in each example as shown in Table 4. The outer layers 20 were formed from composite resin consisting of PVDF resin and 30 vol. % of barium titanate in Example 49; composite resin consisting of soft fluorocarbon polymers and 30 vol. % of barium titanate in Example 50; composite resin consisting of PVF resin and 30 vol. % of barium titanate in Example 51; composite resin consisting of TPO and 30 vol. % of barium titanate in Example 52; composite resin consisting of methacrylic resin and 30 vol. % of barium titanate in Example 53; composite resin consisting of silicone resin and 30 vol. % of barium titanate in Example 54; and composite resin consisting of PEEK resin and 30 vol. % of barium titanate, respectively. In the same manner as Example 35, NN attraction force for paper 40, HH attraction force for paper 40, voltage resistance and ink-resistance were measured in each example. It is clear from the results shown in Table 5 that the NN attraction force for paper 40 was excellent, and the HH attraction force for paper 40, the voltage resistance, and the ink resistance were high in each example.

Examples 56 to 62

The media transport belts 10 were obtained in the same manner as Example 42, but materials for the electrode protective layer 16 and the outer layer 20 were different in each example as shown in Table 5. In Examples 56 to 58, the electrode protective layers 16 were formed from epoxy resin, which is the same resin used in Example 42, and in Examples 59 to 62, the electrode protective layers 16 were formed from amide resin, which is the same resin used in Example 35. The outer layers 20 were formed from composite resin consisting of PVDF resin and 30 vol. % of barium titanate in Example 56; composite resin consisting of soft fluorocarbon polymers and 30 vol. % of barium titanate in Example 57; composite resin consisting of PVF resin and 30 vol. % of barium titanate in Example 58; composite resin consisting of TPO and 30 vol. % of barium titanate in Example 59; composite resin consisting of methacrylic resin and 30 vol. % of barium titanate in Example 60; composite resin consisting of silicone resin and 30 vol. % of barium titanate in Example 61; and composite resin consisting of PEEK resin and 30 vol. % of barium titanate in Example 62, respectively. In the same manner as the above Examples, NN attraction force for paper 40, HH attraction force for paper 40, voltage resistance and ink-resistance were measured in each example. It is clear from the results shown in Table 5 that the NN attraction force for paper 40 was excellent, and the HH attraction force for paper 40, the voltage resistance, and the ink resistance were high in each example.

Example 63

A resin layer 26 having the same composition and the same thickness as those of the electrode protective layer 16, which is on the outer surface of the media transport belt 10 obtained in Example 1, was formed on the inner surface of the media transport belt 10 obtained in Example 1 to obtain the media transport belt 28 as shown in FIG. 5. In the same manner as Example 1, attraction force for paper 40 was measured. It was clear from the result of the measurement that the belt 28 had the attraction force of 10.5 kg and no warping was observed in the width direction.

TABLE 5

| | electrode protective layer type | outer layer resin type | resin amount vol. % | additive type | additive amount vol. % | volume resistivity (Ω · cm) | dielectric constant | NN attraction force (kg) | HH attraction force (kg) | with-standing voltage | ink resis-tance |
|---|---|---|---|---|---|---|---|---|---|---|---|
| EXAMPLE 49 | amide | PFA | 70 | barium titanate | 30 | 1.4E + 14 | 25 | 12.1 | 8.0 | ○ | ○ |
| EXAMPLE 50 | amide | PVDF | 70 | barium titanate | 30 | 3.3E + 13 | 30 | 13.1 | 8.5 | ○ | ○ |
| EXAMPLE 51 | amide | soft fluorocarbon resin | 70 | barium titanate | 30 | 3.4E + 14 | 6.4 | 13.5 | 9.2 | ○ | ○ |
| EXAMPLE 52 | amide | TPO | 70 | barium titanate | 30 | 2.1E + 14 | 23 | 12.5 | 8.5 | ○ | ○ |
| EXAMPLE 53 | amide | methacryl | 70 | barium titanate | 30 | 9.8E + 13 | 26 | 13.2 | 7.8 | ○ | ○ |
| EXAMPLE 54 | amide | silicone | 70 | barium titanate | 30 | 5.5E + 13 | 25 | 14.0 | 8.5 | ○ | ○ |

TABLE 5-continued

| | electrode protective layer type | outer layer resin type | resin amount vol. % | additive type | additive amount vol. % | volume resistivity (Ω · cm) | dielectric constant | NN attraction force (kg) | HH attraction force (kg) | with-standing voltage | ink resis-tance |
|---|---|---|---|---|---|---|---|---|---|---|---|
| EXAMPLE 55 | amide | PEEK | 70 | barium titanate | 30 | 2.2E + 14 | 22 | 12.5 | 7.8 | ○ | ○ |
| EXAMPLE 56 | epoxy | PFA | 70 | barium titanate | 30 | 1.4E + 14 | 25 | 14.5 | 8.3 | ○ | ○ |
| EXAMPLE 57 | epoxy | PVDF | 70 | barium titanate | 30 | 3.3E + 13 | 30 | 15.0 | 8.5 | ○ | ○ |
| EXAMPLE 58 | epoxy | soft fluorocarbon resin | 70 | barium titanate | 30 | 3.4E + 14 | 6.4 | 14.7 | 7.9 | ○ | ○ |
| EXAMPLE 59 | epoxy | TPO | 70 | barium titanate | 30 | 2.1E + 14 | 23 | 15.3 | 8.8 | ○ | ○ |
| EXAMPLE 60 | epoxy | methacryl | 70 | barium titanate | 30 | 9.8E + 13 | 26 | 14.1 | 8.6 | ○ | ○ |
| EXAMPLE 61 | epoxy | silicone | 70 | barium titanate | 30 | 5.5E + 13 | 25 | 16.0 | 9.0 | ○ | ○ |
| EXAMPLE 62 | epoxy | PEEK | 70 | barium titanate | 30 | 2.2E + 14 | 22 | 12.5 | 7.0 | ○ | ○ |

There has thus been shown and described a novel media transport belt which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All changes, modifications, variations and other uses and applications which do not depart from the spirit or scope of the present invention are deemed to be covered by the invention, which is to be limited only by the claims which follow.

What is claimed is:

1. A media transport belt comprising:

a tubular film made of polymer material;

an electrode pattern with conductivity formed on an outer surface of said tubular film; and an electrode protective layer, which is layered on said electrode pattern for protecting the electrode pattern, wherein said electrode protective layer consists of fluorocarbon resin or fluorocarbon resin-additive composite having volume resistivity of from $10^9$ to $10^{15}$ Ωcm, a dielectric constant of equal to or greater than 3.0 and 1% or less water absorption; and said tubular film is made of polymer material having tensile elastic modulus equal to or greater than 200 kg/mm$^2$.

2. A media transport belt according to claim 1, wherein said polymer material is a thermoplastic polyimide resin or nonthermoplastic polyimide resin.

3. A media transport belt according to claim 1, wherein said tubular film is made of a polymer material having a glass transition temperature of 150° C.

4. A media transport belt according to claim 1, wherein said additive contains both or either of a conductive additive and/or an additive having high dielectric constant.

5. A media transport belt according to claim 1, wherein said fluorocarbon resin having 1% or less water absorption is an ink resistant polymer.

6. A media transport belt according to claim 1, wherein an outer layer consisting of a resin with 1% or less water absorption is formed on an outer surface of said electrode protective layer.

7. A media transport belt according to claim 6, wherein said outer layer has a volume resistivity of from $10^9$ to $10^{15}$ Ωcm and a dielectric constant of equal to or greater than 3.0.

8. A media transport belt according to claim 1, wherein a resin layer having the same composition as that of the electrode protective layer is formed along the inner surface of said tubular film.

9. A media transport belt according to claim 6, wherein a resin layer having the same composition as that of the electrode protective layer is formed along the inner surface of said tubular film.

10. A media transport belt according to claim 8, further including another electrode pattern with conductivity formed on the inner surface of said tubular film, located between the tubular film and inner surface resin layer.

* * * * *